US005226652A

United States Patent [19]

Sato

[11] Patent Number: 5,226,652

[45] Date of Patent: Jul. 13, 1993

[54] GOLF CLUB WITH IMPROVED IMPACT PROPERTY

[75] Inventor: Masanori Sato, 4-11-21, Shakugii-cho, Nerima-ku, Tokyo, Japan

[73] Assignees: Maruman Golf Kabushiki Kaisha; Masanori Sato, both of Tokyo, Japan

[21] Appl. No.: 899,583

[22] Filed: Jun. 18, 1992

Related U.S. Application Data

[63] Continuation of Ser. No. 804,538, Dec. 11, 1991, abandoned, which is a continuation of Ser. No. 552,023, Jul. 13, 1990, abandoned.

[30] Foreign Application Priority Data

Jul. 14, 1989 [JP] Japan ..... 1-180570

[51] Int. Cl.[5] ..... A63B 53/04

[52] U.S. Cl. ..... 273/80.2; 273/80.8; 273/80 B

[58] Field of Search ..... 273/80 R, 80 B, 80 C, 273/80.2, 80.4, 80.5, 80.6, 80.8

[56] References Cited

U.S. PATENT DOCUMENTS

| | | | |
|---|---|---|---|
| 695,579 | 3/1902 | Parmele | 273/80.2 |
| 1,131,486 | 3/1915 | Dixon | 273/80 B |
| 1,670,531 | 5/1928 | Cowdery | 273/80 B |
| 1,715,586 | 6/1929 | Barkley | 273/80.8 |
| 1,792,034 | 2/1931 | Reach | 273/80 R |
| 1,958,032 | 5/1934 | Cocke | 273/80.2 |
| 2,124,534 | 7/1938 | Barnhart | 273/80 B |
| 3,764,137 | 10/1973 | Petro | 273/80 B |
| 3,833,223 | 9/1974 | Shulkin | 273/80 B |
| 4,118,033 | 10/1978 | Miyamoto | 273/80 B |

FOREIGN PATENT DOCUMENTS

| | | | |
|---|---|---|---|
| 451584 | 8/1936 | United Kingdom | 273/80 C |

*Primary Examiner*—V. Millin
*Assistant Examiner*—Steven Wong
*Attorney, Agent, or Firm*—Armstrong, Westerman, Hattori, McLeland & Naughton

[57] ABSTRACT

A golf club comprising a head having a neck portion, a shaft having a distal end portion attached to the neck portion, and a neck neighboring portion extending above the neck portion at which the shaft is dynamically bent due to an impact of the head with a golf ball during a swing of the golf club. A member is provided in the shaft for increasing a response to the impact. For example, materials having a high elastic modulus under impact is inserted or a section modulus of the shaft is rearranged in the bendable portion. Accordingly, a lower portion of the shaft is initially bent backward relative to the remaining portion of the shaft and then is moved rapidly forward to cause the head to advance while in contact with the golf ball.

10 Claims, 9 Drawing Sheets

PRESENT INVENTION ($T_C > T_A$)

PRIOR ART ($T_C < T_A$)

PRESENT INVENTION ($T_C = T_B$)

PRIOR ART ($T_C$ / $T_B$)

GOLF CLUB WITH IMPROVED IMPACT PROPERTY

This application is a continuation of application Ser. No. 804,538, filed Dec. 11, 1991, now abandoned, which is in turn a continuation of application Ser. No. 552,023, filed Jul. 13, 1990, now abandoned.

BACKGROUND OF THE INVENTION

1. Field of the Invention

The present invention relates to a golf club having a structure by which a speed of the head of the golf club is improved.

2. Description of the Related Art

A flight distance of a golf ball hit by a golf club varies in accordance with the rebounding property of the golf ball. It is commonly thought that the golf ball flys a longer distance if the golf ball has a larger rebounding force and the face of the head of the golf club is ever harder. Nevertheless, a report has been made stressing that it is not always satisfactory to merely harden the hitting face of the head of the golf club to an infinite hardness, but instead an appropriate hardness should be selected for the head hitting face. For example, Japanese Unexamined Patent Publication (Kokai) No. 61-22875 discloses that there is an optimum hardness of the hitting face of the head of the golf club, which should be determined based on a mechanical impedance, since a rebounding property of the golf ball is reduced if a hardness of the hitting face of the head of the golf club exceeds the optimum hardness value. In addition to the consideration of these quasistatic characteristics, dynamic characteristics are dominant when considering a flight distance of a golf ball.

A flight distance of a golf ball substantially depends on a speed of a head of a swung golf club, a weight of the head, and a take off angle of the golf ball. To increase the speed of the head, it is necessary to increase the speed of the swing of the golf club, but the speed of the head will not be increased as much as expected if the player swings the golf club as if it is a stiff rod. Namely, it is necessary to swing the golf club with a full utilization of an elasticity of the shaft, in order to increase the speed of the head; i.e., if the golf club is swung such that the shaft is elastically deformed at an initial stage of a downswing so that the head lags behind the shaft, and this elastic deformation is restored just before an impact of the head with the golf ball, then the speed of the head due to the elastic restoration function of the shaft is added to the speed of the swing, and thus the speed of the head is increased. From this viewpoint, the elasticity of the shaft is very important, and recently, a swing theory related to a stiffness of the shaft or a frequency theory combining a stiffness of the shaft with a weight of the head has been developed.

Nevertheless, there have been no proposals to increase the speed of the head by the utilization of an impact characteristic derived from a torsional bending of the shaft during the impact. The inventor of the present application found that a portion of the shaft near the distal end thereof is dynamically bent in the form of an obtuse U for a short time, as illustrated in FIG. 4B of the attached drawings by the arrow X, due to an impact of the head with the golf ball. The impact lasts for only a very short time, and usually such a bending of the shaft due to an impact of the head with the golf ball cannot be observed. Therefore, there have been no conventional concepts of increasing the speed of the head and stabilizing a flight direction of the golf ball by taking into consideration the impact of the head with the golf ball.

The inventor of the present application visualized the deformation of the distal end portion of the shaft and found that the distal end portion and a portion of the shaft near the neck of the head are dynamically bent, and concluded that such a dynamic bending of the shaft due to an impact of the head with the golf ball is important in consideration of an increase of the speed of the head of the golf club. In brief, when the head comes into contact with the golf ball, it is displaced backward relative to the shaft for a short time, and accordingly, the shaft is subjected at the proximate end thereof to a force of the swing which causes the shaft to continue to advance, and at the distal end thereof, is subjected to a force of the head which causes the shaft to be displaced backward, resulting in a bending of the distal end portion of the shaft. Namely, while the entire golf club has an advancing inertia during the swing, the head only is subjected to a backward force due to the impact and a portion of the shaft is instantaneously deformed thereby, and in this instant, an elastic strain energy is accumulated in the shaft. Namely, the head is displaced backward relative to the shaft by contact with the golf ball, and since the swing is continued, the head with the shaft advances relative to the golf ball and remains in contact with the golf ball after the first contact of the head with the golf ball. Thereafter, the golf ball rebounds from the head a certain time after the first contact therebetween. In this specification, the time from a point at which the golf ball is first in contact with the head to a point at which the golf ball rebounds from the head is referred to as "a contact time Tc". It has been found that, in conventional golf clubs, the initial bending of the distal end portion of the shaft due to the impact of the head with the golf ball is restored after this contact time Tc has elapsed. Therefore, the head is lags behind the shaft, and this is one reason for reducing the speed of the head.

SUMMARY OF THE INVENTION

An object of the present invention is to provide a golf club in which the golf club is subjected to an impact torsional bending and an elastic strain energy is accumulated in a distal end portion of the shaft and a neck neighboring portion thereabove, and which ensures an increase of the speed of the golf ball, and preferably improves the direction of flight of the golf ball, by effectively adding the elastic strain energy of the shaft to the golf ball within the contact time Tc.

According to the present invention, there is provided a golf club comprising a head having a neck portion, a shaft having a distal end portion attached to the neck portion of the head, and a neck neighboring portion adjacent to the distal end portion at which the shaft is dynamically bent due to an impact of the head with a golf ball during a swing of the golf club, so that the neck neighboring portion is initially bent backward relative to the remaining portion of the shaft, and means located in the distal end portion and the neighboring portion for increasing a response to the impact, whereby the neck neighboring portion is moved forward after the initial backward bending thereof to cause the head to advance relative to the shaft in the direction of a flight of the golf ball, while the head is in contact with the golf ball.

With this arrangement, it is possible for manufacturers to vary their designs, etc., to suit a particular purpose, for example, to use materials having a high elastic modulus under impact or to rearrange a section modulus of the materials, to increase the response to an impact of the head with a golf ball. The shaft is dynamically bent partially due to an impact of the head with a golf ball, and since the response to the impact of the bent portion of the shaft is increased according to the present invention, after the head comes into contact with the golf ball, and before the golf ball rebounds from the head, i.e., while the head is in contact with the golf ball, the head, which is bent backward relative to the shaft due to the contact with the golf ball, advances inversely relative to the shaft. This advance of the head relative to the shaft is added to the basis speed of the swing of the shaft and raises the speed of the head. This phenomenon is hereinafter referred to as a snap-back effect.

BRIEF DESCRIPTION OF THE DRAWINGS

The present invention will become more apparent from the following description of the preferred embodiment with reference to the accompanying drawings; in which.

DESCRIPTION OF THE PREFERRED EMBODIMENTS

Figure 1:
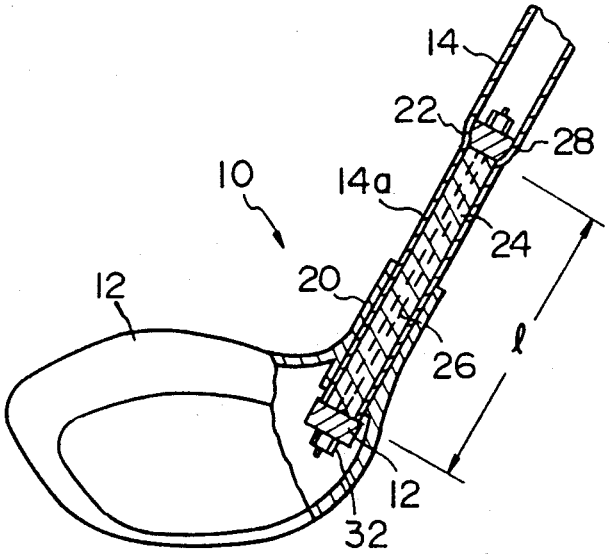
FIG. 1 is a partial cross-sectional view of a golf club according to the first embodiment of the present invention.
Figure 2:
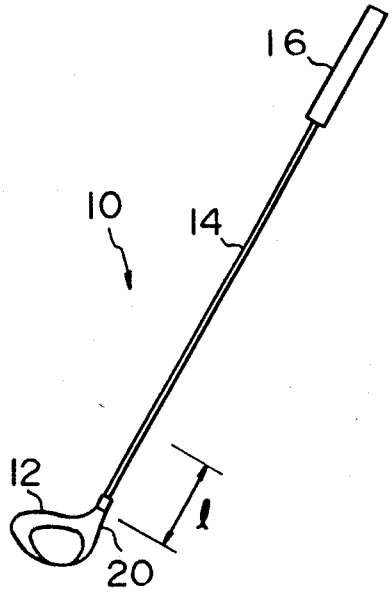
FIG. 2 is a schematic view of the golf club of FIG. 1.

Referring to FIGS. 1 and 2, a golf club 10 comprises a head 12 and a shaft 14, with a grip 16 attached to the upper, proximal end portion of the shaft 14. In the embodiment, the head 12 is a hollow structure and includes an integral neck portion 20; the lower distal end portion of the shaft 14 being fitted in the neck portion 20 and fixed thereto.

As shown in FIGS. 1 and 2, the shaft 14 has a lower portion **14*a* (as indicated by the arrow l) which is formed such that the lower portion 14*a* has a response to an impact distinctive from that of the upper portion of the shaft 14 thereabove, i.e., the response to the impact of the lower portion 14*a*** is greater than that of the upper portion.

As shown in FIG. 1, the shaft 14 has a step 22, which defines a large shaft portion thereabove and a small shaft portion therebelow. In the embodiment shown in FIG. 1, the step 22 defines an upper extremity of the lower portion **14*a* in which the response to the impact is increased and the lower extremity of the lower portion 14*a* is defined by the distal end of the shaft 14 in the region fitted in the neck portion 20. In this way, the lower portion 14*a* at which the response to the impact is increased includes the distal end portion in the region fitted to the neck portion 20 and a neck neighboring portion adjacent to the distal end portion and extending above the neck portion 20. The length of the lower portion 14*a* will vary, for example, in accordance with the length of the neck portion 20; typically, the length of the neck neighboring portion extending above the neck portion 20 is from several centimeters to 30 centimeters. An elongated core member 24 made of a material highly responsive to an impact is inserted in the lower portion 14*a* of the shaft 14 and in close contact with the inner surface thereof. The core member 24**, for example, can be made from materials having a high elastic modulus upon impact, such as an amorphous alloy, a variety of composite materials, intermetallic compounds, and ceramics.

In FIG. 1, the core member 24 has a central through hole through which a bolt or rod 26 is extended. Abutting washer-like members 28 and 30 are attached to the bolt 26 on either side of the core member 24; one of the abutting members 28 engaging with the head of the bolt 26 and the other abutting member 30 on the side of the head 12 able to be adjustably tightened by a nut 32 engaged with the threaded end portion of the bolt 26, so that the core member 24 can be adjustably tightened. Accordingly, it is possible to provide a response to an impact corresponding to an oscillatory mode proper to that shaft 14, by adjusting the core member 24. It is possible to adjustably tighten the nut 32 by removing the sole plate (not shown) of the head in the embodiment. Where the head does not have a hollow structure, it is possible to adjustably tighten the nut 32 by removing the shaft 14 from the neck portion 20, and to design the nut 32 and the abutting member 30 on the side of the head 12 to be a size such that the nut 32 and the abutting member 30 can pass through the neck portion 20 for an insertion thereof.

Figure 3:
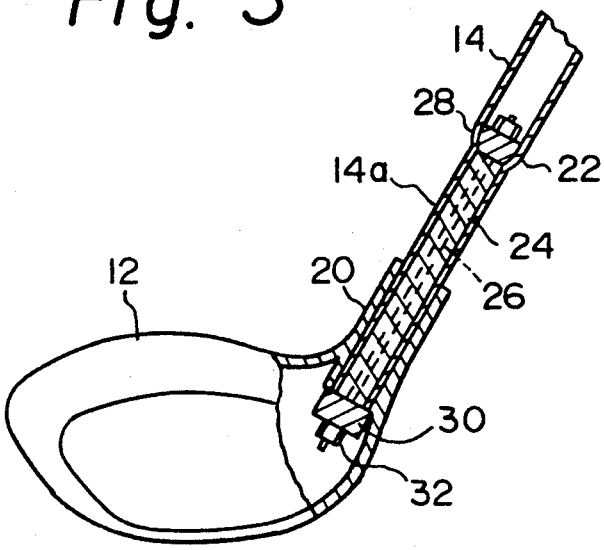
FIG. 3 is a partial cross-sectional view, similar to FIG. 1, of a golf club according to the second embodiment of the present invention.

In the embodiment shown in FIG. 1, the core member 24 is fixed to the shaft 14 by substantially abutting the abutting member 28 with the step 22 of the shaft 14 and the abutting member 30 with the end of the shaft 14. Alternatively, in the embodiment shown in FIG. 3, the core member 24 is fixed to the shaft 14 by substantially abutting the abutting member 28 with the step 22 of the shaft 14 and the abutting member 30 with the end of the shaft 14 and the inner surface of the neck portion 20, to thereby increase the rigidity of the integrally connected assembly.

Figures 4A, 4B, 4C, 4D:
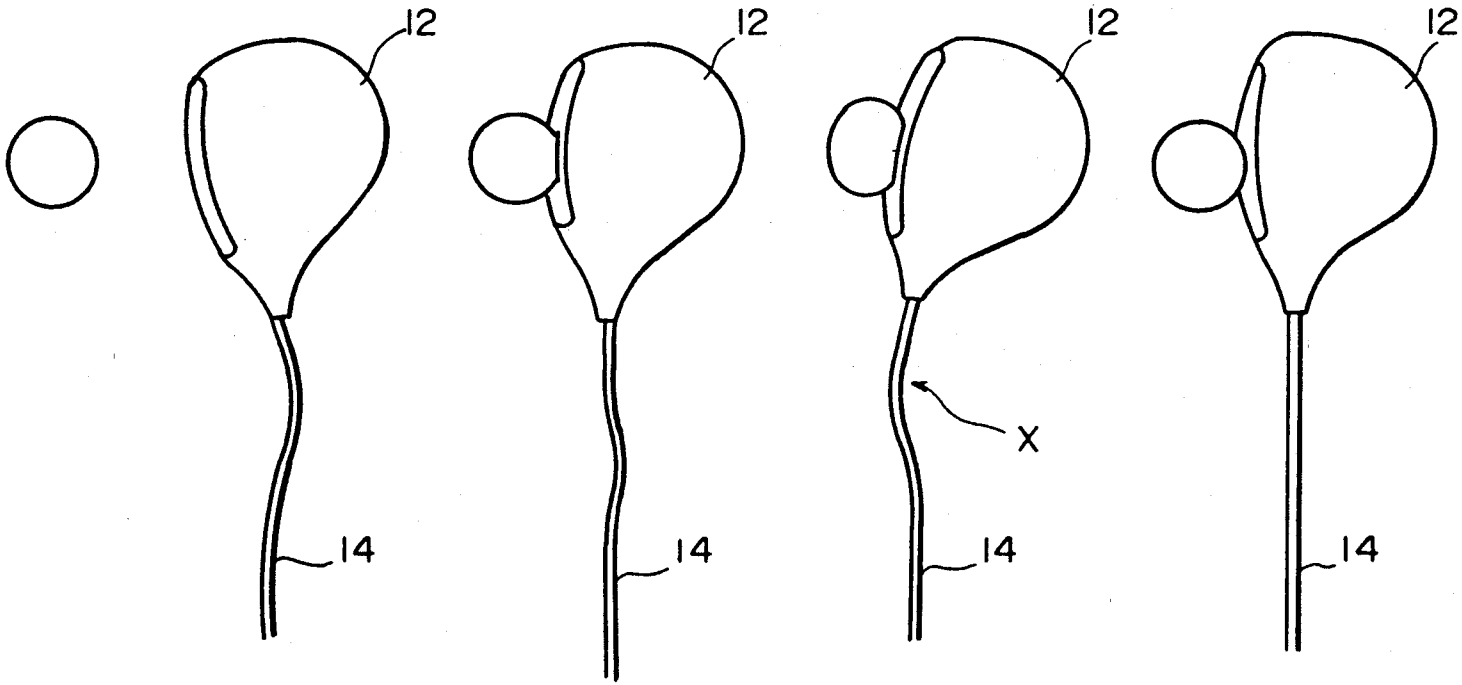
FIGS. 4A to 4D are views illustrating points in the progress of a swing of the golf club.
Figure 14:
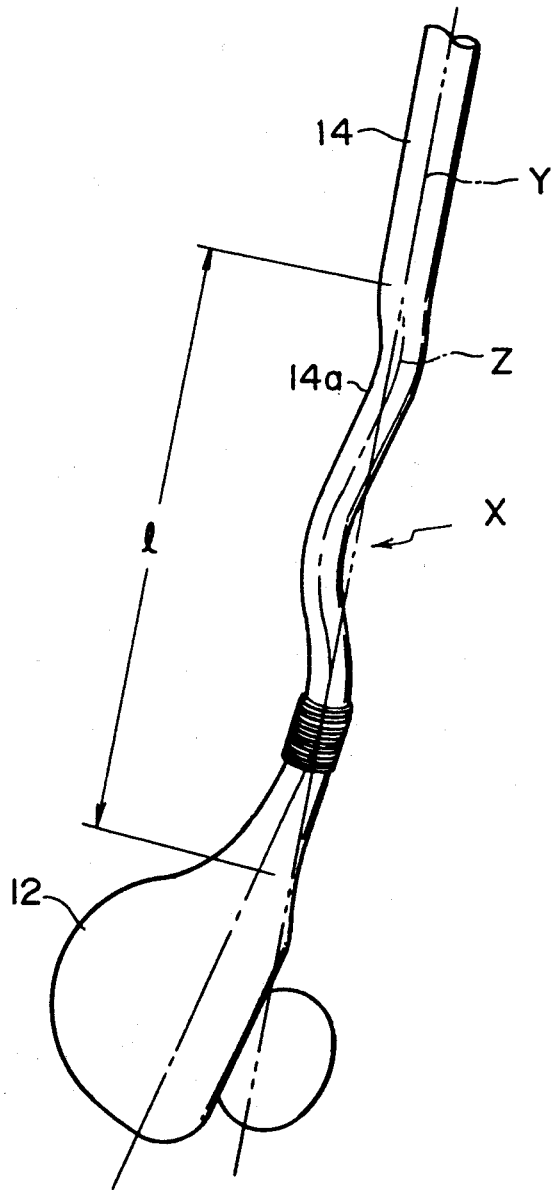
FIG. 14 is a detailed view of the golf club of FIG. 4B.

FIGS. 4A to 4D are views illustrating points of the progress of a swing of the golf club 10, wherein FIG. 4A shows a point just before an impact and FIG. 4B shows a point just after a contact of the head 12 with the golf ball. The head 12 is displaced backward relative to the shaft 14, due to the impact of the head 12 with the golf ball, and a part of the lower portion 14*a* of the shaft 14 is bent as indicated by the arrow X. This bending occurs for a short time upon impact, and it is difficult to see this with the naked eye. Accordingly, it is determined by visualizing the deformation of the lower portion 14*a* of the shaft 14 during the impact, and analyzing the visualized model. FIG. 14 shows this situation in greater detail, in which the double dotted semibroken line Y is an axis of the shaft 14 and the semibroken line Z is a center line of the deformed lower portion 14*a* of the shaft 14. It can be appreciated that the head 12 is inclined relative to the axis Y, and thus the loft angle thereof is changed.

The bent portion X presents reference data adapted when assuming the time and the value of a displacement of the head 12 backward relative to the shaft 14. Therefore, it is possible to determine a response to an impact with reference to the bent portion X. It is also possible to finely adjust the stiffness of the core member 24 with reference to the bent portion X, to obtain a response to an impact corresponding to an oscillatory mode proper to the shaft 14. One method of adjusting is to move the position of the bending portion X on the shaft 14 toward the head 12, to thereby reduce the period of oscillatory movement of the head 12 due to the impact.

FIG. 4C shows a point at which the golf ball is just about to rebound from the head 12. The golf ball is in contact with the head 12 during a time from the point of FIG. 4A to the point of FIG. 4C, and this time is referred to as the contact time Tc, as previously described. If the bent portion X is restored at the point of FIG. 4C, and thus the head 12 is advanced relative to the shaft 14, the speed of the head 12 is increased by the snap back effect, to an extent greater than that of the conventional golf club. The golf ball finally leaves the head 12, as shown in FIG. 4D, and the oscillatory movement of the head 12 is damped.

Figure 5A:
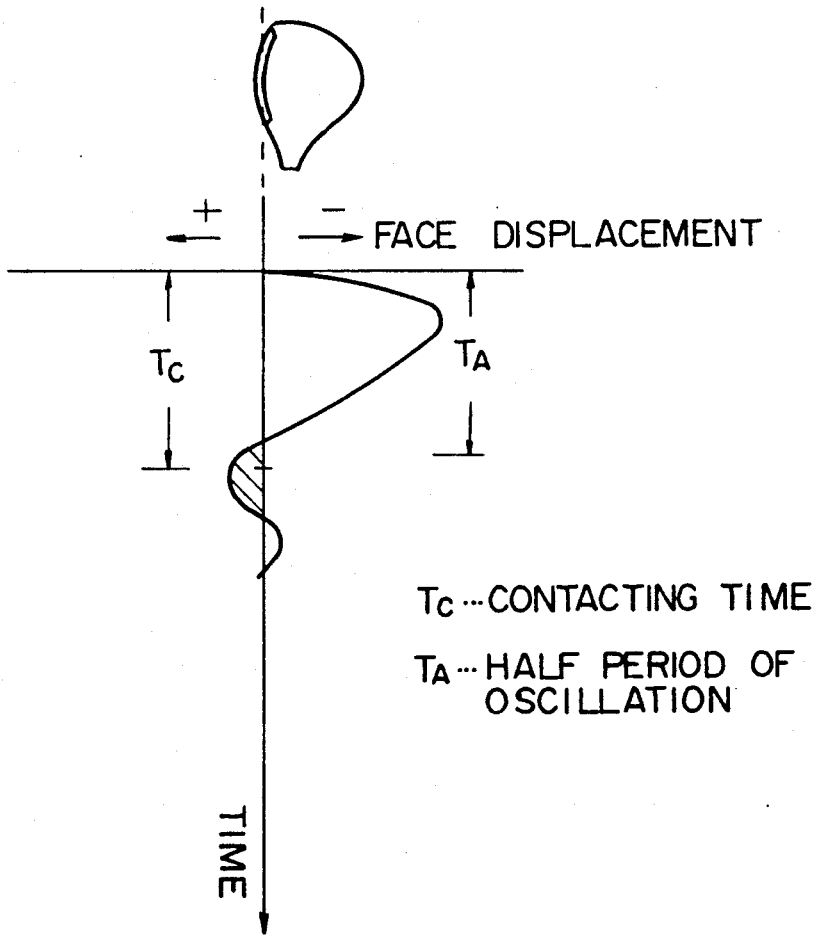
FIG. 5A is a view illustrating the oscillatory movement of the head of the golf club according to the present invention.

FIG. 5A is a view illustrating the oscillatory movement of the head 12 of the golf club 10 according to the present invention, during an impact. If the reference position of the head 12 relative to the shaft 14 is selected from the point of FIG. 4A, the head 12 is displaced backward relative to the axis of the shaft 14 by the contact of the head 12 with the golf ball, so that the distal end portion and the neck neighboring portion of the shaft 14 are dynamically bent and an elastic strain energy is accumulated therein. The head 12 starts to return, after reaching the peak of wave of the oscillation, to the reference position when a half period $T_A$ of the oscillation of the oscillatory system formed by the head 12 and the shaft 14 has elapsed, and then the head 12 advances relative to the shaft 14; this relative advancing movement contributing to an increase of the speed of the head 12. This movement causes an effective transfer of the elastic strain energy accumulated in the shaft 14 to the golf ball, to increase the speed of the golf ball in flight. To increase the speed of the head 12 in this manner, it is important to reduce the period of oscillation so that the time from point of impact to the point at which the head 12 starts to advance relative to the shaft 14, i.e., the half period $T_A$ of the oscillation, is shorter than the contact time $T_C$.

Figure 5B:
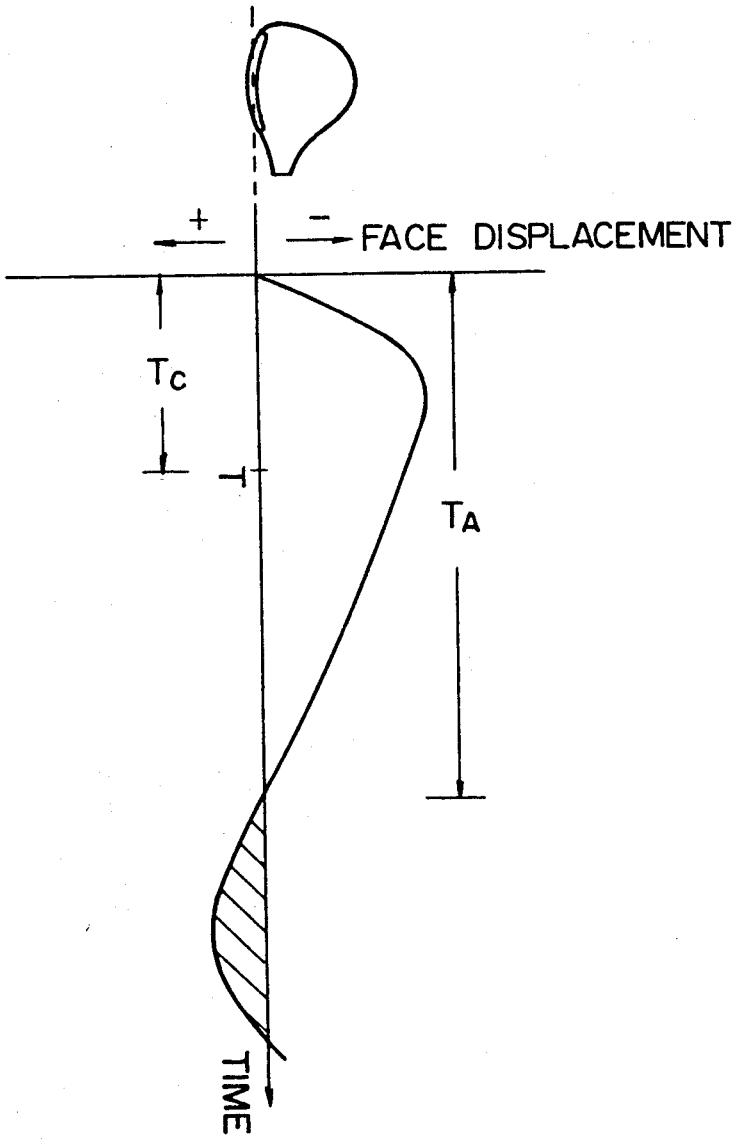
FIG. 5B is a view illustrating the oscillatory movement of the head of the golf club according to the prior art.

FIG. 5B is a view illustrating the oscillatory movement of the head of the golf club according to the prior art, during impact. The head is also displaced backward relative to the shaft by the contact of the head 12 with the golf ball, so that the distal end portion and the neck neighboring portion of the shaft are dynamically bent and an elastic strain energy is accumulated therein, but since the golf ball rebounds from the head before the half period of the oscillation has elapsed, the elastic strain energy accumulated in the shaft is not effectively transferred to the golf ball, and thus an increase of the speed of the golf ball in flight cannot be expected.

Figure 6A:
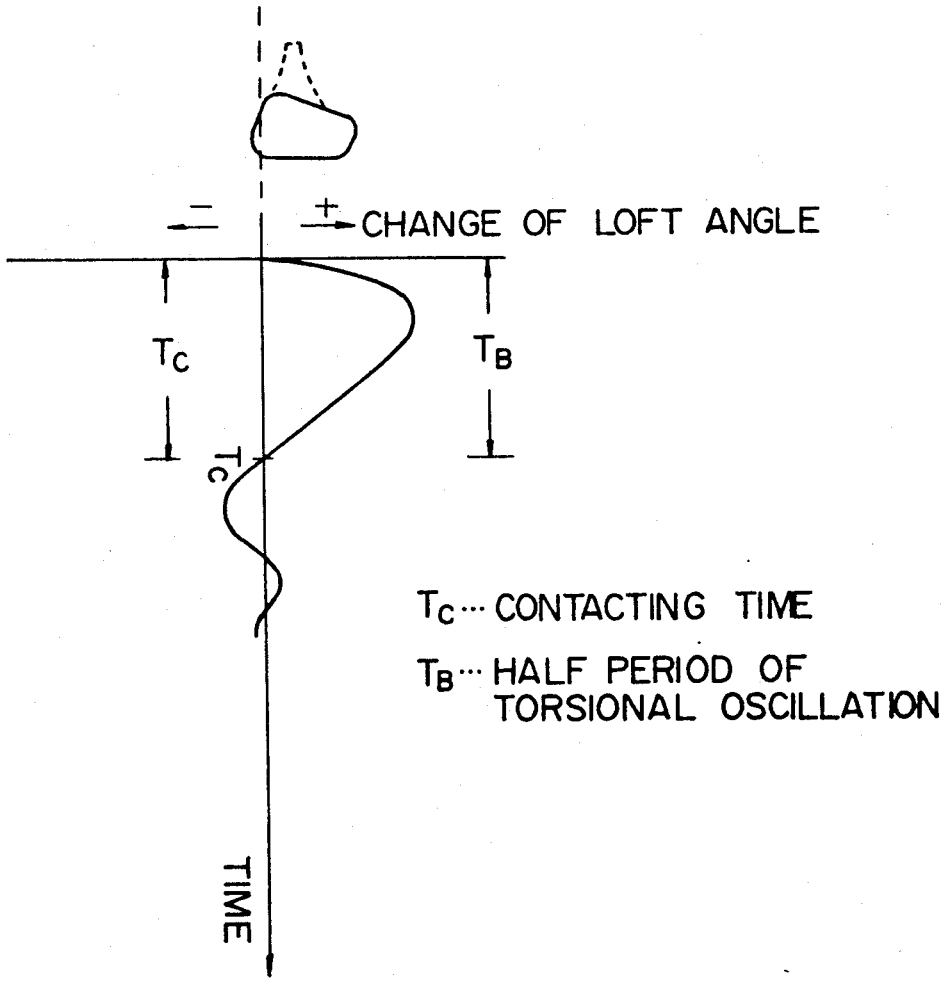
FIG. 6A is a view illustrating a change of the loft angle of the oscillatory head of the golf club according to the present invention.
Figure 6B:
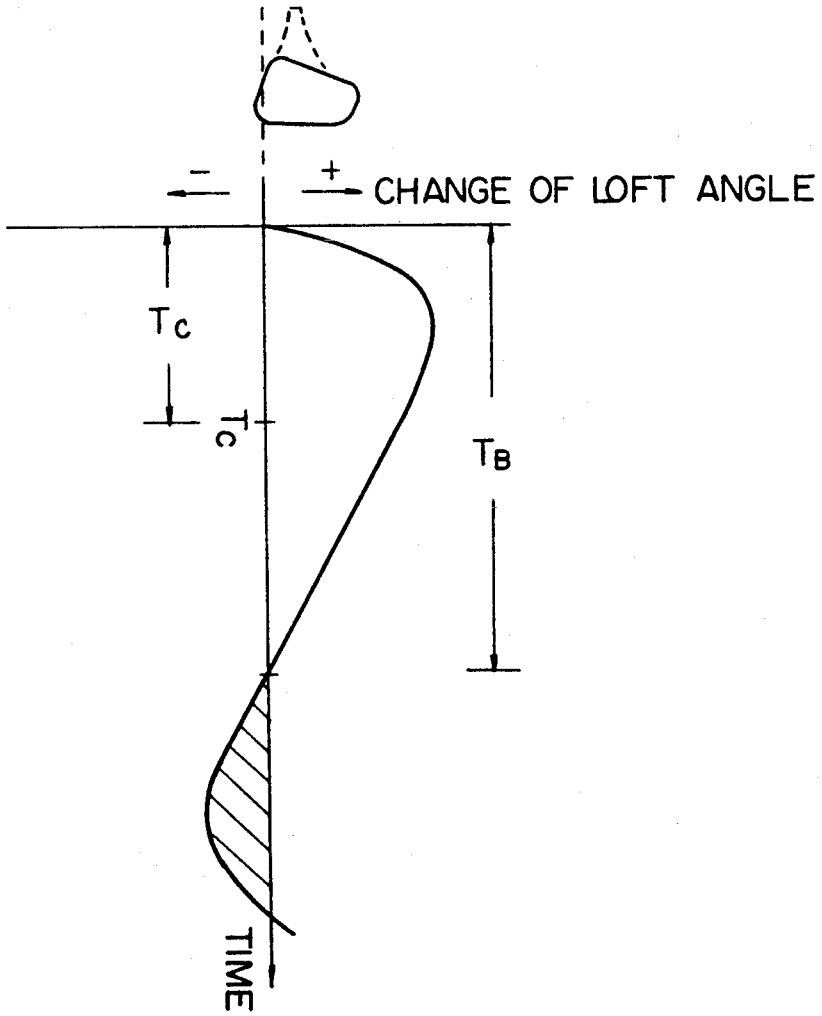
FIG. 6B is a view illustrating a change of the loft angle of the oscillatory head of a golf club according to the prior art.

FIGS. 6A and 6B are views illustrating a change of the loft angle of the oscillatory head of the golf club during the impact, according to the present invention and the prior art, respectively. The head 12 and the shaft 14 are subjected to torsion and bending simultaneously, so that the loft angle is changed and the flight direction is deflected. Therefore, it is preferable to restore the change of the loft angle at the time of the rebound of the golf ball from the head. In this regard, preferably the half period $T_B$ of the torsional oscillation of the shaft 14 is equal to the contact time $T_C$. In the prior art, the half period $T_B$ of the torsional oscillation is greater than the contact time $T_C$, and thus the golf ball rebounds from the head before the change of the loft angle thereof is restored, and therefore, the flight direction is deflected.

Figure 7:
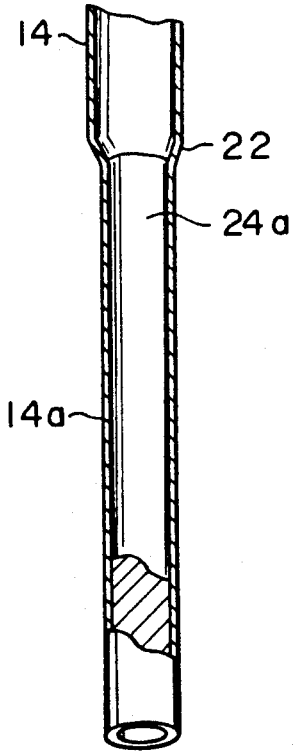
FIG. 7 is a partial cross-sectional view of the shaft of the golf club according to the third embodiment of the present invention.

FIG. 7 shows another embodiment of the shaft 14 of a golf club which is generally similar to the golf club 10 shown in FIG. 1. In this embodiment, a high strength material 24*a* is inserted in the lower portion 14*a* of the shaft 14. The high strength material 24*a* is held in close contact to the inner surface of the shaft 14 and formed from, for example, fiber reinforced plastic (FRP), a whisker, amorphous material, intermetallic compound, or metal.

Figure 8:
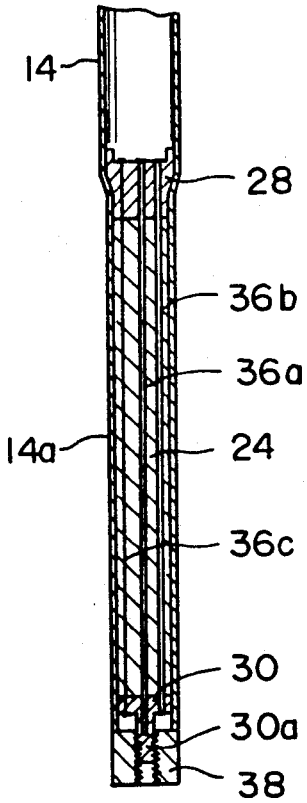
FIG. 8 is a partial cross-sectional view of the shaft of the golf club according to the fourth embodiment of the present invention.
Figure 9:
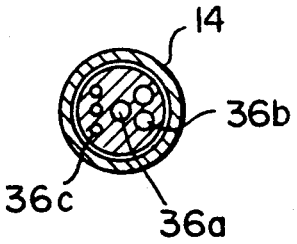
FIG. 9 is a cross-sectional view of the shaft of FIG. 8.

FIG. 8 shows another embodiment of the shaft 14 of the similar golf club, in which a core member 24 with holes drilled axially therethrough is inserted in the lower portion 14*a* of the shaft 14, and highly responsive wires 36*a*, 36*b* and 36*c* are extended through the respective holes of the core member 24 between the abutting members 28 and 30, to be retained thereat. One of the abutting members 28 engages with the step 28 of the shaft 14, and the other abutting member 30 has a threaded portion 30*a*, a fastener 38 having mating thread being arranged in abutment with the end of the shaft 14, and the tension of the wires 36*a*, 36*b* and 36*c* can be adjusted by tightening the fastener 38 against the abutting member 30. The wires 36*a*, 36*b* and 36*c* can be formed from high tensile wire having high elastic modulus, such as piano wires, amorphous fibers, or intermetallic compounds. Also as shown in FIG. 9, the wires 36*a*, 36*b*, and 36*c* have different cross-sectional areas, and the distribution thereof can be adjusted to change the bending stiffness of the shaft 14, partially within the range of the lower portion 14*a*.

Figure 10:
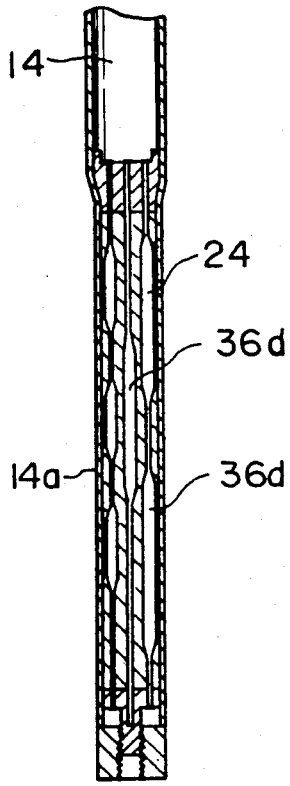
FIG. 10 is a partial cross-sectional view of the shaft of the golf club according to the fifth embodiment of the present invention.

FIG. 10 shows still another embodiment of the shaft 14 of the similar golf club in which the shape of each of the high strength wires 36*d* is changed in the lengthwise direction thereof.

Figure 11A:
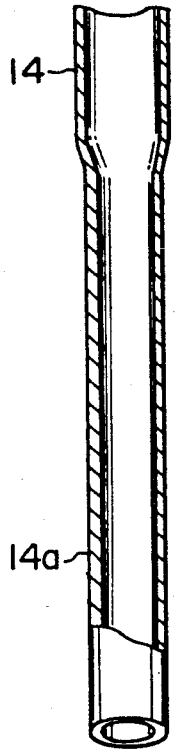
FIG. 11A is a partial cross-sectional view of the shaft of the golf club according to the sixth embodiment of the present invention.
Figure 11B:
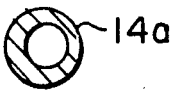
FIG. 11B is a cross-sectional view of the shaft of FIG. 11A.

FIGS. 11A and 11B show still another embodiment of the shaft 14, wherein the shaft 14 is a hollow shaft having an upper portion with a constant wall thickness and the lower portion 14*a* with a varying wall thickness. The largest wall thickness of the lower portion 14*a* is made greater than the wall thickness of the upper portion, to thereby increase the stiffness upon impact. It is possible to located the largest wall thickness side of the lower portion 14*a* to the rear in view of the swing, but it is also possible to locate the farther side in conformity with the actual oscillatory mode. Although the wall thickness of the lower portion 14*a* is changed diametrically in this example, it is also possible to change the wall thickness axially.

Figure 12:
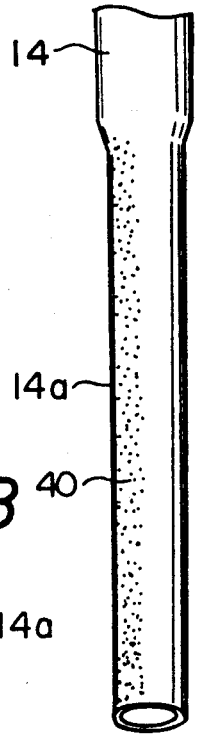
FIG. 12 is a partial cross-sectional view of the shaft of the golf club according to the seventh embodiment of the present invention.

FIG. 12 shows still another embodiment of the shaft 14, in which the shaft 14 has a lower portion 14*a* treated by shot peening to apply a negative residual stress thereto. It is not necessary to treat the full circumference of the lower portion 14*a* by shot peening, and only a portion receiving a tensile force, torsional force or bending force during impact need be treated. It is also possible to carry out a heat treatment on a required portion, to apply a negative residual stress as a means of increasing the elastic modulus of the portion bent during the impact. It is also possible to carry out a similar treatment on the neck portion of the head 12.

Figure 13:
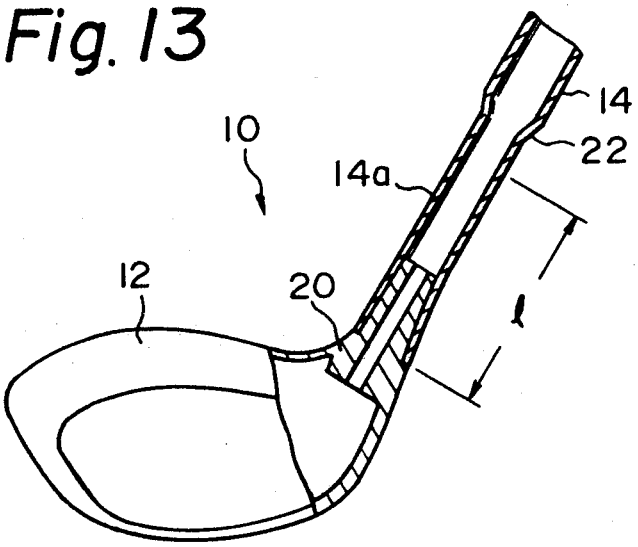
FIG. 13 is a partial cross-sectional view of the golf club according to the eighth embodiment of the present invention.

FIG. 13 shows another embodiment of the golf club 10. This golf club 10 has a shaft 14 with a lower portion 14*a* fitted over the neck portion of the head 12 and the diameter of the lower portion 14*a* of the shaft 14 becomes greater from the step 22 toward the distal end of the shaft 14. By this arrangement, the rigidity of the lower portion 14*a* of the shaft 14 is increased to thereby increase the response to the impact.

Although the present invention is described with reference to the preferred embodiments, it is possible to modify the present invention within the scope of the present invention. For example, it is advantageous to provide a one way reinforcement material such as Aramid fiber or one way metal in the lower portion of the shaft, the neck portion of the head, or the core member, coinciding with the direction of the stress. It is also possible to combine some of the above-described embodiments.

I claim:

1. A golf club comprising a head having a neck portion, a shaft having a distal end portion attached to said neck portion of said head and neck neighboring portion adjacent to said distal end portion for which said shaft is dynamically bent due to an impact of said head with a golf ball during a swing of said golf club so that said neck neighboring portion is initially bent backward relative to the remaining portion of said shaft, and means located in said distal end portion and said neck neighboring portion for controlling a response to the impact, wherein said neck neighboring portion is moved forward after the initial bending thereof to cause said head to advance relative to said shaft in the direction of a flight of the golf ball while said head is in contact with the golf ball, wherein said means for controlling the response to the impact comprises core means highly responsive to an impact and extending consecutively in said distal end portion and said neck neighboring portion of said shaft, and wherein said core means comprises an elongated core member having a central through hole, a rod extending through said central through hole of said core member, and abutting members adjustably attached to said rod on either side of said core member so that said core member can be adjustably tightened.

2. A golf club according to claim 1, wherein said abutting member on the side of the distal end of said shaft also abuts against said distal end of said shaft and the neck portion of said head.

3. A golf club according to claim 1, wherein said core means comprises a strong material.

4. A golf club according to claim 1, wherein said core means comprises at least one wire.

5. A golf club according to claim 4, wherein a size of said wire is locally varied.

6. A golf club according to claim 1, wherein said means for controlling the response to an impact comprises a change of a thickness of a wall of said shaft.

7. A golf club according to claim 6, wherein said shaft has a thickness in a wall thereof which is diametrically changed.

8. A golf club according to claim 6, wherein said shaft has a thickness in a wall thereof which is axially changed.

9. A golf club according to claim 1, wherein said means for controlling the response to an impact comprises a portion of said shaft which receives a tensile force upon impact and to which a negative residual stress is applied.

10. A golf club according to claim 1, wherein said means for controlling the response to an impact comprises a portion of said shaft corresponding to said distal end portion and said neck neighboring portion in which a diameter of the shaft becomes greater toward the distal end of said shaft.

* * * * *